US007382346B2

(12) United States Patent
Moon

(10) Patent No.: US 7,382,346 B2
(45) Date of Patent: Jun. 3, 2008

(54) DRIVING DEVICE OF FLAT DISPLAY PANEL AND METHOD THEREOF

(75) Inventor: Seong-Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 578 days.

(21) Appl. No.: 10/825,368

(22) Filed: Apr. 16, 2004

(65) Prior Publication Data

US 2004/0207612 A1 Oct. 21, 2004

(30) Foreign Application Priority Data

Apr. 18, 2003 (KR) ..... 10-2003-0024756

(51) Int. Cl.
*G09G 3/36* (2006.01)

(52) U.S. Cl. ..... 345/100; 345/98

(58) Field of Classification Search ..... 345/55–100, 345/204–214

See application file for complete search history.

(56) References Cited

U.S. PATENT DOCUMENTS

| | | | | |
|---|---|---|---|---|
| 4,707,692 | A * | 11/1987 | Higgins et al. | 345/76 |
| 5,041,823 | A * | 8/1991 | Johnson et al. | 345/94 |
| 5,093,655 | A * | 3/1992 | Tanioka et al. | 345/96 |
| 5,436,747 | A * | 7/1995 | Suzuki | 345/96 |
| 6,246,385 | B1 * | 6/2001 | Kinoshita et al. | 345/87 |
| 6,894,667 | B1 * | 5/2005 | Lin | 345/87 |
| 7,046,222 | B2 * | 5/2006 | Kim et al. | 345/82 |
| 7,119,767 | B1 * | 10/2006 | Komiya et al. | 345/76 |

* cited by examiner

*Primary Examiner*—David L Lewis
(74) *Attorney, Agent, or Firm*—Ked & Associates, LLP

(57) ABSTRACT

A driving device of a flat display panel and its method are disclosed. The driving device includes a scan driving unit for applying scan pulses to both ends of each scan line of the flat display panel

15 Claims, 7 Drawing Sheets

DRIVING DEVICE OF FLAT DISPLAY PANEL AND METHOD THEREOF

BACKGROUND OF THE INVENTION

1. Field of the Invention

The present invention relates to a flat display panel and, more particularly, to a driving device of a flat display panel and its method.

2. Description of the Background Art

In general, a flat display panel has discharge cells arranged in a matrix form. The discharge cells are radiated when a difference between a voltage applied to a data line and a voltage applied to a scan line of the flat display panel is higher than a threshold voltage of the discharge cells at their intersection. A quantity of outputted light differs depending on a difference of the applied voltage or current.

If, however, a voltage difference at the intersection of the data line and the scan line of the flat display panel is lower than the threshold voltage of the discharge cell, the discharge cell would not be radiated or output an invisible feeble light.

Among the flat display panels, an MIM (Metal Insulator Metal: MIM)-type FED (Field Emission Display) requiring a high resistance of an electrode, a low voltage and a high current shows a difference of brightness between the left and right sides of a screen because a voltage applied to scan lines is dropped due to a resistance of the scan lines.

The MIM-type FED uses a few V~10V, which is quite low as compared to that of other flat display panels and a high current. Since the applied voltage is low, the MIM-type FED does not have a problem for a small screen but when it comes to a large screen, the voltage drop is generated due to the resistance existing in the scan lines, so a suitable value of voltage can not be applied to a portion of the scan line distanced from a driving circuit which applies the voltage. Consequently, there is a difference of brightness between the left side and the right side of the screen due to the voltage drop caused by the resistance of the scan lines.

The construction of the general MIM-type FED will now be described with reference to FIG. 1.

FIG. 1 is a plane view showing disposition of data lines and scan lines of the general MIM-type FED.

As shown in FIG. 1, in the general MIM-type FED, data lines D1~Dm are arranged vertically at regular intervals and scan lines S1~Sn are arranged horizontally at regular intervals, so that the data lines and the scan lines intersect each other in a matrix form.

As the size of the MIM-type FED is increased, the length of the scan lines S1~Sn is increased, so a voltage drop generated due to the resistance of the scan lines S1~Sn is accordingly increased in proportion to the increased length. The resistance value of the scan lines S1~Sn is generally about 100~150 ohm.

A driving device of the MIM-type FED will now be described with reference to FIG. 2.

FIG. 2 is a block diagram showing a driving device of the MIM-type FED in accordance with a conventional art.

As shown in FIG. 2, the driving device of the conventional MIM-type FED includes a controller 10 for converting an inputted image signal to image data and outputting the converted image data and a control signal; a data driving unit 30 for outputting a data pulse on the basis of the image data and the control signal received from the controller 10; a scan driving unit 20 for outputting a scan pulse on the basis of the control signal inputted from the controller 10; a display panel 40 for displaying an image signal on the basis of the data pulse inputted from the data driving unit 30 and the scan pulse inputted from the scan driving unit 20.

An operational principle of the driving device of the conventional MIM-type FED is as follows.

First, the controller 10 receives an image signal, converts it into image data, and outputs the converted image data and a control signal for controlling the data driving unit 30 and the scan driving unit 20.

The data driving unit 30 outputs a data pulse to the panel 40 on the basis of the image data and the control signal which have been inputted from the controller 10, and the scan driving unit 20 outputs a scan pulse to the panel 40 on the basis of the control signal which has been inputted from the controller 10.

Thereafter, the panel 40 displays the image signal on the basis of the data pulse which has been inputted from the data driving unit 30 and the scan pulse which has been inputted from the scan driving unit 20.

Waveforms of the data pulse and the scan pulse inputted to the panel 40 will now be described with reference to FIG. 3.

FIG. 3 shows waveforms of the data pulse and the scan pulse inputted to the conventional MIM-type FED.

As shown in FIG. 3, the scan pulse inputted from the scan driving unit 20 is applied to the scan lines S1~Sn of the panel 40, and the data pulse inputted from the data driving unit 30 is applied to the data lines D1~Dm of the panel 40. Accordingly, the discharge cells positioned at intersections of the scan pulses and the data pulses are selectively radiated to display an image. At this time, the discharge cells are radiated according to voltage differences between the data pulses and the scan pulses inputted to the data lines D1~Dm and scan lines S1~Sn, and brightness of the screen varies according to a voltage difference or a current difference.

After driving of the discharge cells is terminated, a reset pulse is applied to the scan lines S1~Sn to discharge an electric charge charged in the discharge cells.

However, since there is a scan resistance in the scan lines S1~Sn connecting scan electrodes of the discharge cells, a voltage drop occurs in proportion to a position of the scan line as it gets away from the scan driving unit 20 which applies the scan pulse.

The voltage drop occurring in the scan lines will now be described with reference to FIG. 4.

FIG. 4 is a graph showing a brightness of a screen according to positions of scan lines of the MIM-type FED in accordance with the conventional art.

As shown in FIG. 4, in the conventional MIM-type FED, when a scan current is applied to the scan lines S1~Sn, as a position of the scan line gets away from the scan driving unit 20, a voltage drop (VD) occurs corresponding to a value obtained by multiplying the scan resistance and the scan current, making a difference of brightness between the left side and the right side of the screen.

As mentioned above, the driving device of the MIM-type FED is disadvantageous in that the difference of brightness between the left side and the right side of the screen when an image is displayed on the screen due to the voltage drop according to the resistance of the scan line.

SUMMARY OF THE INVENTION

Therefore, an object of the present invention is to provide an apparatus for driving a flat display panel capable of enhancing a difference of brightness of a screen by applying scan pulses to both ends of each scan line of a flat display panel.

To achieve these and other advantages and in accordance with the purpose of the present invention, as embodied and broadly described herein, there is provided a driving device of a flat display panel including a scan driving unit for applying a scan pulse to both ends of each scan line of a flat display panel.

To achieve the above object, there is also provided a driving device of a flat display panel including: a first scan driving unit for applying a scan pulse to one side of each scan line of a flat display panel and a second scan driving unit for applying the scan pulse to the other side of each scan line.

To achieve the above object, there is also provided a driving method of a flat display panel including: applying scan pulses to both ends of each scan line of a flat display panel.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

A driving device of a flat display panel and its method in accordance with a preferred embodiment of the present invention, which are capable of improving a difference of brightness of a screen by applying a scan pulse to both ends of each scan line of a flat display panel, will now be described with reference to the accompanying drawings.

The driving device of a flat display panel and its method in accordance with a preferred embodiment of the present invention can be applied to any flat display panel so long as it has a structure of data lines and scan lines in a matrix form.

Figure 1:
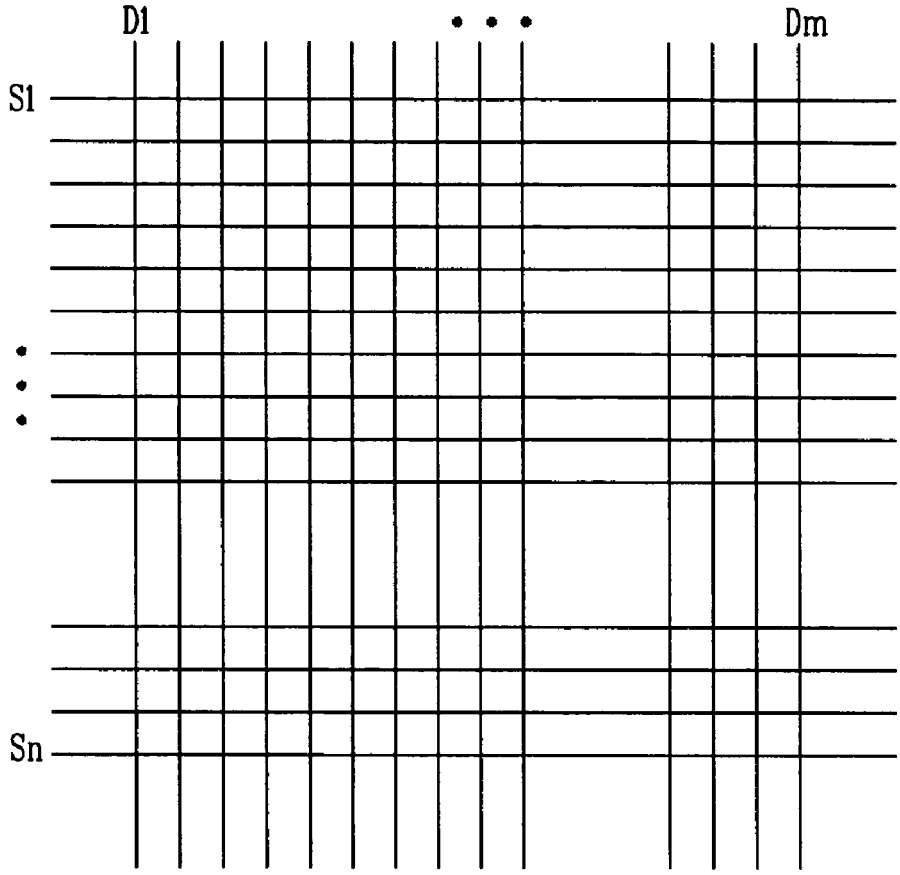
FIG. 1 CONVENTIONAL ART
FIG. 1 is a plane view showing the disposition of data lines and scan lines of a general MIM-type FED.
Figure 2:
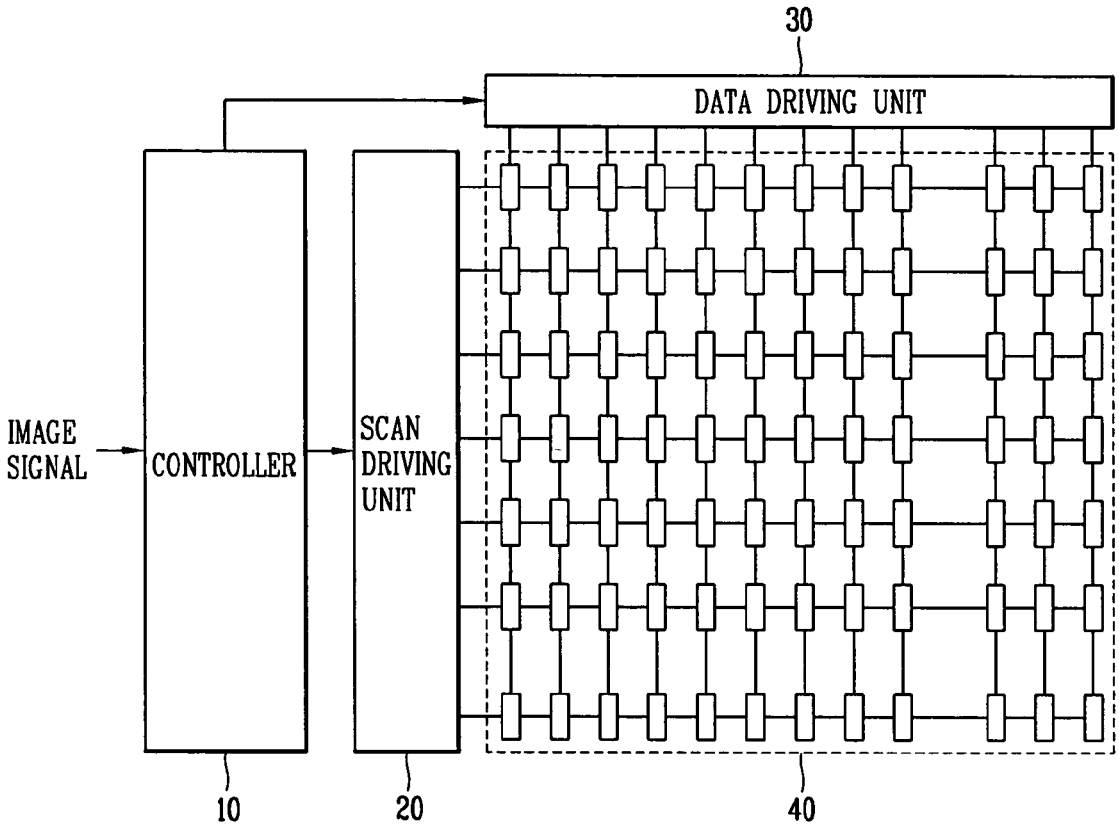
FIG. 2 CONVENTIONAL ART
FIG. 2 is a block diagram showing a driving device of a MIM-type FED in accordance with a conventional art.
Figure 3:
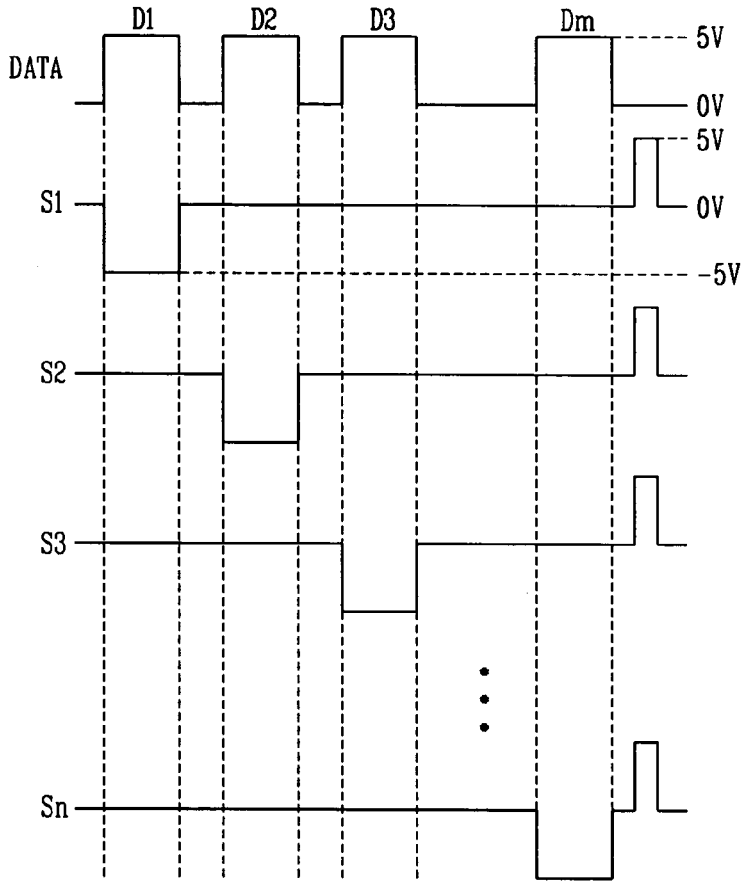
FIG. 3 CONVENTIONAL ART
FIG. 3 shows waveforms of a data pulse and a scan pulse inputted to the MIM-type FED in accordance with the conventional art.
Figure 4:
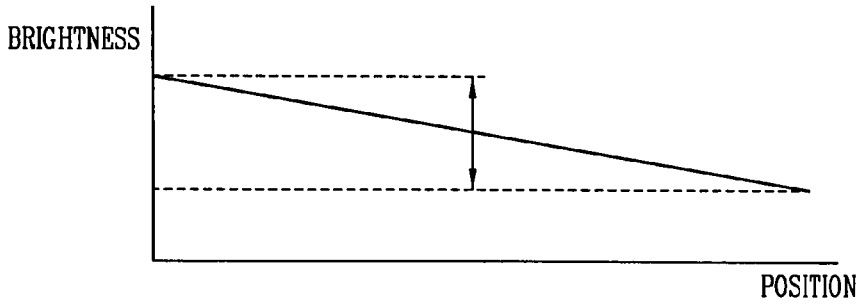
FIG. 4 CONVENTIONAL ART
FIG. 4 is a graph showing brightness of a screen according to positions of scan lines of the MIM-type FED in accordance with the conventional art.
Figure 5:
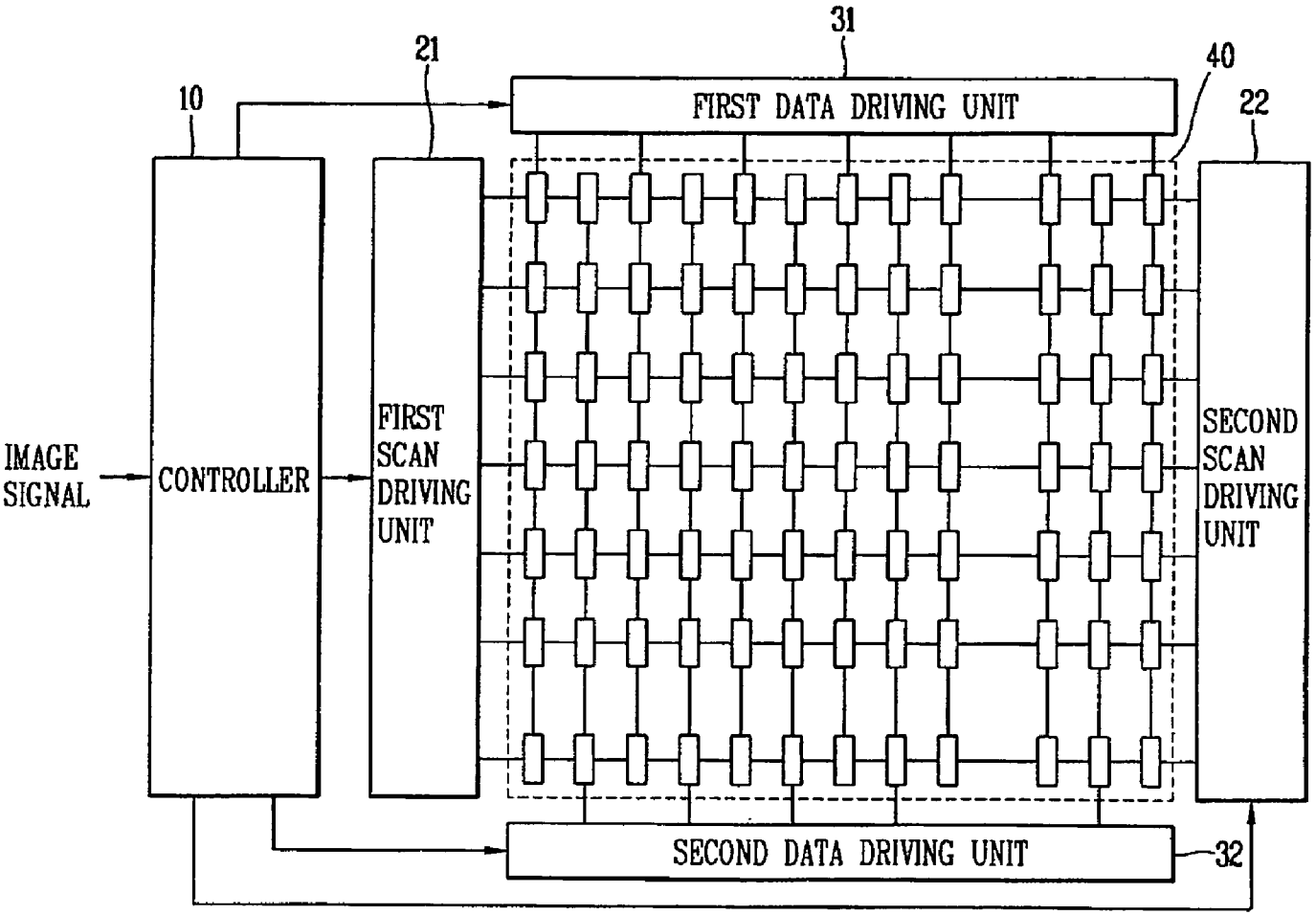
FIG. 5 is a block diagram showing a driving device of a flat display panel in accordance with the present invention.

FIG. 5 is a block diagram showing a driving device of a flat display panel in accordance with the present invention.

As shown in FIG. 5, the driving device of a flat display panel includes a controller 10 for converting an inputted image signal into image data and controlling the converted image data and a control signal; a first data driving unit 31 for outputting a first data pulse to every odd number of times of data lines on the basis of the image data and the control signal received from the controller 10; a second data driving unit 32 for outputting a second data pulse to every even number of times of data lines on the basis of the image data and the control signal inputted from the controller 10; a first scan driving unit 21 for outputting a scan pulse to one side of each scan line on the basis of the control signal inputted from the controller 10; and a second scan driving unit 22 for outputting a scan pulse to the other side of each scan line on the basis of the control signal inputted from the controller 10.

The operational principle of the first and second scan driving unit of the flat display panel will now be described with reference to FIG. 6.

Figure 6:
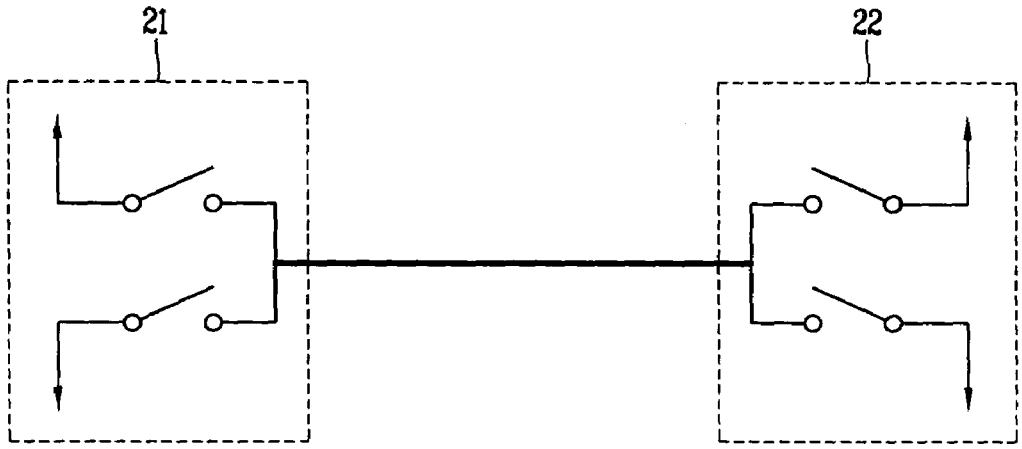
FIG. 6 illustrates an operation principle of a scan driving unit of FIG. 5.

FIG. 6 illustrates an operation principle of a scan driving unit of FIG. 5.

As shown in FIG. 6, scan pulses inputted from the first and second scan driving units 21 and 22 connected to both ends of each scan line constituting the panel are outputted on the basis of a control signal inputted from the controller 10. The scan pulses inputted from the first and second scan driving units 21 and 22 have the same voltage, the same phase and the same pulse width.

The driving device of the flat display panel constructed as described above operates as follows.

First, the controller 10 converts an inputted image signal into image data and outputs the converted image data and a control signal for controlling the first and second data driving units 31 and 32 and the first and second scan driving units 21 and 22. Of the converted image data, the odd number of times of image data are outputted to the first data driving unit 31 and the even number of times of image data are outputted to the second data driving unit 32.

The first and second data driving units 31 and 32 output the data pulse to the data lines D1~Dm of the panel on the basis of the control signal and the image data inputted from the controller 10. The first and second scan driving units 21 and 22 output the scan pulse to the scan lines S1~Sn on the basis of the control signal inputted from the controller 10.

The waveforms of the data pulse and the scan pulse inputted to the panel 40 will now be described with reference to FIG. 7.

Figure 7:
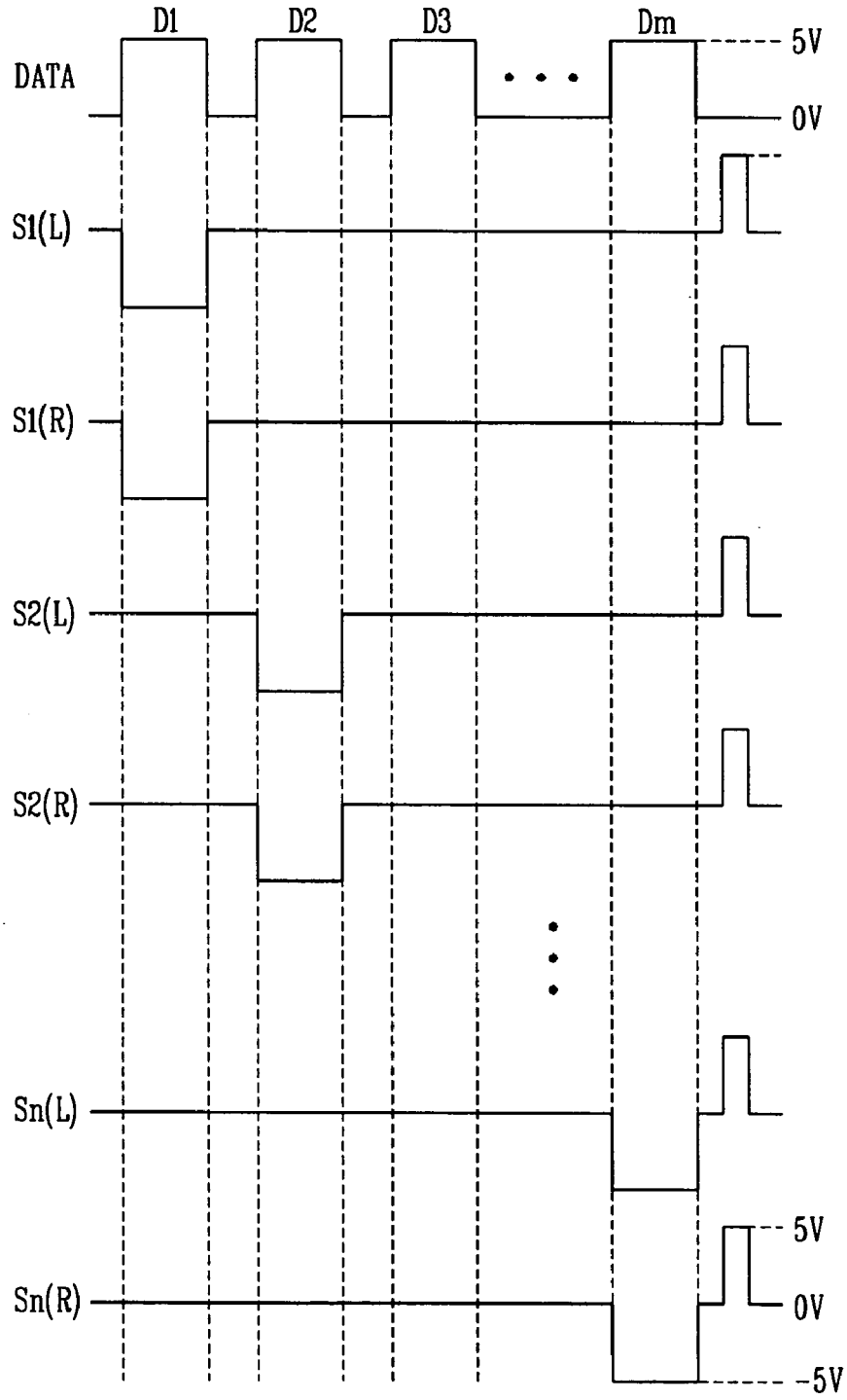
FIG. 7 shows waveforms of a data pulse and a scan pulse inputted to the flat display panel in accordance with the present invention.

FIG. 7 shows waveforms of a data pulse and a scan pulse inputted to the flat display panel in accordance with the present invention.

As shown in FIG. 7, the first scan driving unit 21 outputs a scan pulse from one side of the panel 40 and the second scan driving unit 22 outputs a scan pulse having the same voltage, phase and pulse width as those of the scan pulse that has been inputted from the first scan driving unit at the other side of the panel 40.

Thereafter, the scan pulses inputted from the first and second scan driving units 21 and 22 and the data pulses inputted from the first and second data driving units 31 and 32 are synchronized, and due to voltage differences between the synchronized data pulses and scan pulses, the discharge cells of the flat display panel are radiated. Namely, discharge cells at intersections of the scan lines S1~Sn to which scan pulses are inputted and the data lines D1~Dm to which the data pulses are inputted are driven.

The above process is performed on every scan line S1~Sn of the flat display panel, whereby the inputted image signal is displayed through the panel 40.

Brightness of the screen according to positions of the scan lines of the flat display panel in accordance with the present invention will now be described with reference to FIGS. 8A and 8B.

Figure 8A:
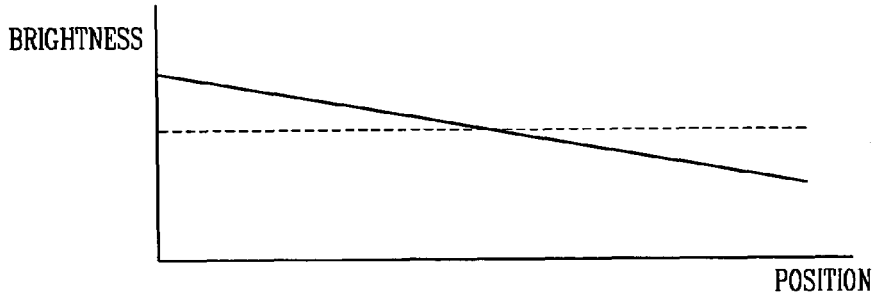
FIGS. 8A to 8C are graphs showing brightness of screens according to positions of scan lines of the flat display panel in accordance with the present invention.
Figure 8B:
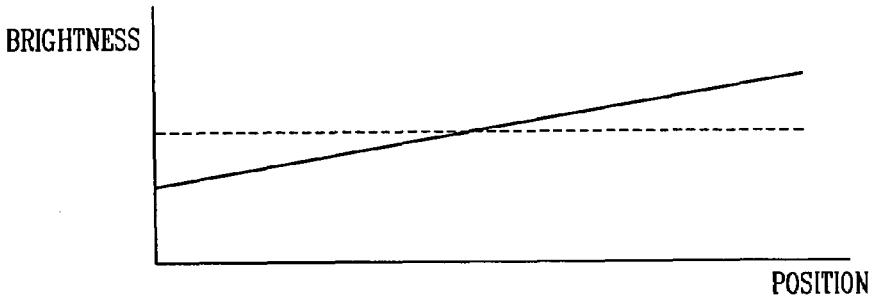
Figure 8C:
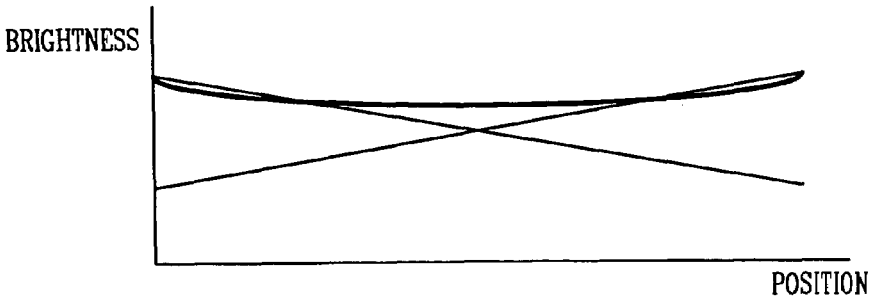

FIGS. 8A to 8C are graphs showing brightness of screens according to positions of scan lines of the flat display panel in accordance with the present invention.

As shown in FIGS. 8A to 8C, when scan pulses are applied to only one side of the panel 40 through the first scan driving unit 21, the left side of the screen is brighter than the right side of the screen or the right side of the screen is brighter than the left side of the screen due to the voltage drop.

In addition, when the scan pulses are simultaneously applied to both one side and the other side of the panel 40 through the first and second scan driving units 21 and 22, brightness of the left side and the right side of the screen is uniform.

As so far described, the driving device of the flat display panel in accordance with the present invention has such an advantage that since scan pulses are applied to both ends of the scan electrode of the flat display panel, lowering of the scan voltage caused by the resistance of the scan electrode is reduced and thus a difference of brightness of the screen can be enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A driving device of a flat display panel comprising:

a scan driving circuit for simultaneously applying scan pulses to both ends of each scan line of the flat display panel;

a first data driving circuit for applying data pulses to odd numbered data lines among data lines of the flat display panel; and a second data driving circuit for applying data pulses to even numbered data lines of the data lines, wherein the scan pulses have a same voltage, a same phase and a same pulse width.

2. The device of claim 1, further comprising a controller for outputting a control signal for controlling the scan driving circuit.

3. The device of claim 2, wherein the controller outputs a control signal for simultaneously applying the scan pulses.

4. A driving device of a flat display panel comprising:

a first scan driving circuit for applying scan pulses to one side of each scan line of the flat display panel;

a second scan driving circuit for applying the scan pulses to the other side of each scan line;

a first data driving circuit for applying data pulses to odd numbered data lines among data lines of the flat display panel; and a second data driving circuit for applying data pulses to even numbered data lines of the data lines, wherein the scan pulses have a same voltage, a same phase and a same pulse width.

5. The device of claim 4, further comprising a controller for outputting a control signal to control the first and second scan driving circuits.

6. The device of claim 5, wherein the controller outputs a control signal to simultaneously apply the scan pulses.

7. A driving method of a flat display panel comprising:

simultaneously applying scan pulses to both ends of each scan line of the flat display panel;

applying data pulses to odd numbered data lines among data lines of the flat display panel; and applying data pulses to even numbered data lines of the data lines, wherein the scan pulses have a same voltage, a same phase and a same pulse width.

8. The method of claim 7, further comprising outputting a control signal to simultaneously apply the scan pulses.

9. The method of claim 7, wherein applying data pulses to odd numbered data lines includes a first data driving unit applying data pulses to the odd numbered data lines.

10. The method of claim 9, wherein applying data pulses to even numbered data lines includes a second data driving unit applying data pulses to the even numbered data lines.

11. The device of claim 1, wherein the odd numbered data lines extend from the first data driving circuit on a first side of the panel to a second side of the panel, and the even numbered data lines extend from the second data driving circuit on the second side of the panel to the first side of the panel.

12. The device of claim 11, wherein data pulses for the odd numbered data lines are applied by only the first data driving circuit, and data pulses for the even numbered data lines are applied by only the second data driving circuit.

13. The device of claim 1, wherein the first data driving circuit applies data pulses to only odd numbered data lines, and the second data driving circuit applies data pulses to only even numbered data pulses.

14. The device of claim 4, wherein the odd numbered data lines extend from the first data driving circuit on a first side of the panel to a second side of the panel, and the even numbered data lines extend from the second data driving circuit on the second side of the panel to the first side of the panel.

15. The device of claim 14, wherein data pulses for the odd numbered data lines are applied by only the first data driving circuit, and data pulses for the even numbered data lines are applied by only the second data driving circuit.

* * * * *